US007722400B2

(12) United States Patent
Bixler et al.

(10) Patent No.: US 7,722,400 B2
(45) Date of Patent: May 25, 2010

(54) DIFFERENTIAL PAIR ELECTRICAL CONNECTOR HAVING CROSSTALK SHIELD TABS

(75) Inventors: Craig A. Bixler, Elmhurt, IL (US); John C. Laurx, Aurora, IL (US); Neil A. Martin, Naperville, IL (US); Tom Carlson, Maumelle, AZ (US)

(73) Assignee: Molex Incorporated, Lisle, IL (US)

( * ) Notice: Subject to any disclaimer, the term of this patent is extended or adjusted under 35 U.S.C. 154(b) by 286 days.

(21) Appl. No.: 11/771,739

(22) Filed: Jun. 29, 2007

(65) Prior Publication Data

US 2008/0096433 A1 Apr. 24, 2008

Related U.S. Application Data

(60) Provisional application No. 60/818,140, filed on Jun. 30, 2006, provisional application No. 60/817,857, filed on Jun. 30, 2006.

(51) Int. Cl.
*H01R 13/648* (2006.01)

(52) U.S. Cl. ..... 439/607.07

(58) Field of Classification Search ..... 439/607–609
See application file for complete search history.

(56) References Cited

U.S. PATENT DOCUMENTS

| | | | | |
|---|---|---|---|---|
| 5,066,236 | A | 11/1991 | Broeksteeg | |
| 5,104,341 | A | 4/1992 | Gilissen et al. | |
| 5,860,816 | A | 1/1999 | Provencher et al. | |
| 6,231,391 | B1 * | 5/2001 | Ramey et al. | 439/608 |
| 6,293,827 | B1 | 9/2001 | Stokoe | |
| 6,409,543 | B1 | 6/2002 | Astbury, Jr. et al. | |
| 6,506,076 | B2 * | 1/2003 | Cohen et al. | 439/608 |
| 6,602,095 | B2 | 8/2003 | Astbury, Jr. et al. | |
| 6,709,294 | B1 | 3/2004 | Cohen et al. | |
| 6,776,659 | B1 | 8/2004 | Stokoe et al. | |
| 6,780,059 | B1 | 8/2004 | Payne et al. | |
| 6,786,771 | B2 | 9/2004 | Gailus | |
| 6,808,399 | B2 * | 10/2004 | Rothermel et al. | 439/608 |
| 6,814,619 | B1 | 11/2004 | Stokoe et al. | |
| 6,872,085 | B1 | 3/2005 | Cohen et al. | |
| 7,074,086 | B2 | 7/2006 | Cohen et al. | |
| 7,094,102 | B2 | 8/2006 | Cohen et al. | |
| 7,108,556 | B2 | 9/2006 | Cohen et al. | |
| 7,163,421 | B1 | 1/2007 | Cohen et al. | |
| 2002/0111069 | A1 | 8/2002 | Astbury et al. | |
| 2004/0264153 | A1 | 12/2004 | Payne et al. | |
| 2006/0068640 | A1 | 3/2006 | Gailus | |
| 2006/0276081 | A1 | 12/2006 | Cohen et al. | |
| 2007/0004282 | A1 | 1/2007 | Cohen et al. | |
| 2007/0042639 | A1 | 2/2007 | Manter et al. | |
| 2007/0054554 | A1 | 3/2007 | Do et al. | |

* cited by examiner

*Primary Examiner*—Briggitte R Hammond
(74) *Attorney, Agent, or Firm*—Stephen L. Sheldon

(57) ABSTRACT

A differential pair connector includes a housing having receptacles for receiving differential pair conductors and electrically conductive shielding tabs extending away from the housing between the receptacles for reducing crosstalk between the differential pairs. The tabs insert into a mated connector when an interconnect is formed. By inserting into the second connector, the shield tabs extend a larger ground plane around each differential pair, thus significantly reducing crosstalk within the connector. The connector can be a high density GbX® style daughter card connector mated to a GbX® style backplane connector.

18 Claims, 6 Drawing Sheets

DIFFERENTIAL PAIR ELECTRICAL CONNECTOR HAVING CROSSTALK SHIELD TABS

RELATED APPLICATION

This patent application claims the benefit of U.S. Provisional Patent Application Nos. 60/817,857, filed Jun. 30, 2006, and 60/818,140 filed Jun. 30, 2006, which are both incorporated by reference in their entireties.

This application is related to U.S. patent application No. 11/771,666, entitled "Differential Pair Connector Featuring Reduced Crosstalk," filed on the same date as the present application, assigned to the same assignee and identifying Craig A. Bixler, John C. Laurx and Neil A. Martin as the inventors. This related application is incorporated by reference in its entirety as though fully set forth herein for everything it describes.

TECHNICAL FIELD

The present invention relates generally to electrical connectors, and more specifically, to high-frequency electrical connectors where signal crosstalk is a performance consideration.

BACKGROUND

Electronic devices continue to shrink in size, yet increase in speed and complexity. This has lead to the widespread availability of small electronic components capable of driving high-speed signals (e.g., above one GHz) over printed circuit board (PCB) tracks. The increasing use of these high-speed components has created a significant demand for high performance electrical connectors that support such signal frequencies and denser PCB track configurations, while at the same time requiring less space.

Transmitting high speed signals over differential pair channels is an increasingly popular technique for high bandwidth transmission between PCBs. In a typical high bandwidth system, "daughter card" PCBs are connected to a backplane using mated connectors. The backplane is itself a layered circuit board having, among other things, differential pair tracks formed therein for carrying high frequency signals between the daughter cards.

In such systems, one critical variable that affects bandwidth between PCBs is crosstalk. Generally, crosstalk is the electrical interference in a channel caused by a signal traveling through a neighboring channel. Under many circumstances, the presence of excessive crosstalk degrades system performance and negatively impacts bandwidth. High-speed signaling standards, such the Institute of Electrical and Electronics Engineers (IEEE) 802.3 XAUI standard require four channels of differential pairs operating at 3.125 GHz. Additional high-speed standards incorporating differential pairs include PCI Express, SONET OC-12, SONET OC-48, Gigabit Ethernet, HD-SDI, Serial RapidIO, CEI-6G and SerialLite II. Proprietary protocols are also often implemented in backplanes and other environments.

Using conventional connector technology, it is difficult or impossible to reliably transmit multiple channels of differential signals in close proximity to one another at high speed. The data rates of computing equipment, such as networking gear, have been consistently increasing in speed. As data rates increase, crosstalk between channels becomes more of a problem as it tends to degrade bandwidth. Thus, in differential pair systems, it is important that daughter cards and backplanes minimize the amount of crosstalk between differential pairs. It is also important for the PCB connectors between the daughter cards and backplanes to minimize crosstalk.

In view of the foregoing, there is a substantial need for an electrical connector that yields reduced crosstalk in high signal density, high bandwidth applications.

SUMMARY

Embodiments of the invention provide an improved differential pair connector that includes means for significantly reducing crosstalk between differential pair channels. Further embodiments provide an improved differential pair connector that can be embodied in an economical, high-density connector suitable for use in demanding high bandwidth applications.

In accordance with an exemplary embodiment of the invention, as described infra, an electrical connector comprises a housing having receptacles for receiving differential pair conductors. Extending away from the housing, between the receptacles, are electrically conductive shielding tabs for reducing crosstalk between the differential pairs. The tabs insert into a mated connector when an interconnect is formed. By inserting into the second connector, the shield tabs extend a larger ground plane around each differential pair, thus significantly reducing crosstalk within the connector. In one embodiment, the connector can be a GbX®-style daughter card connector mated to a GbX®-style backplane connector.

Other aspects, features, embodiments, processes and advantages of the invention will be or will become apparent upon examination of the following figures and detailed description. It is intended that all such additional features, embodiments, processes and advantages be included within this description, be within the scope of the invention, and be protected by the accompanying claims.

BRIEF DESCRIPTION OF THE DRAWINGS

The drawings are solely for the purpose of illustration and do not define the limits of the invention. Furthermore, the components in the figures are not necessarily to scale, emphasis instead being placed upon illustrating the principles of the invention. In the figures, like reference numerals designate corresponding parts throughout the different views.

DETAILED DESCRIPTION

The following detailed description, which references to and incorporates the drawings, describes and illustrates one or more specific embodiments of the invention. These embodiments are offered not to limit but only to exemplify and teach the invention, are shown and described in sufficient detail to enable those skilled in the art to practice the invention. Thus, where appropriate to avoid obscuring the invention, the description may omit certain information known to those of skill in the art.

Figure 1:
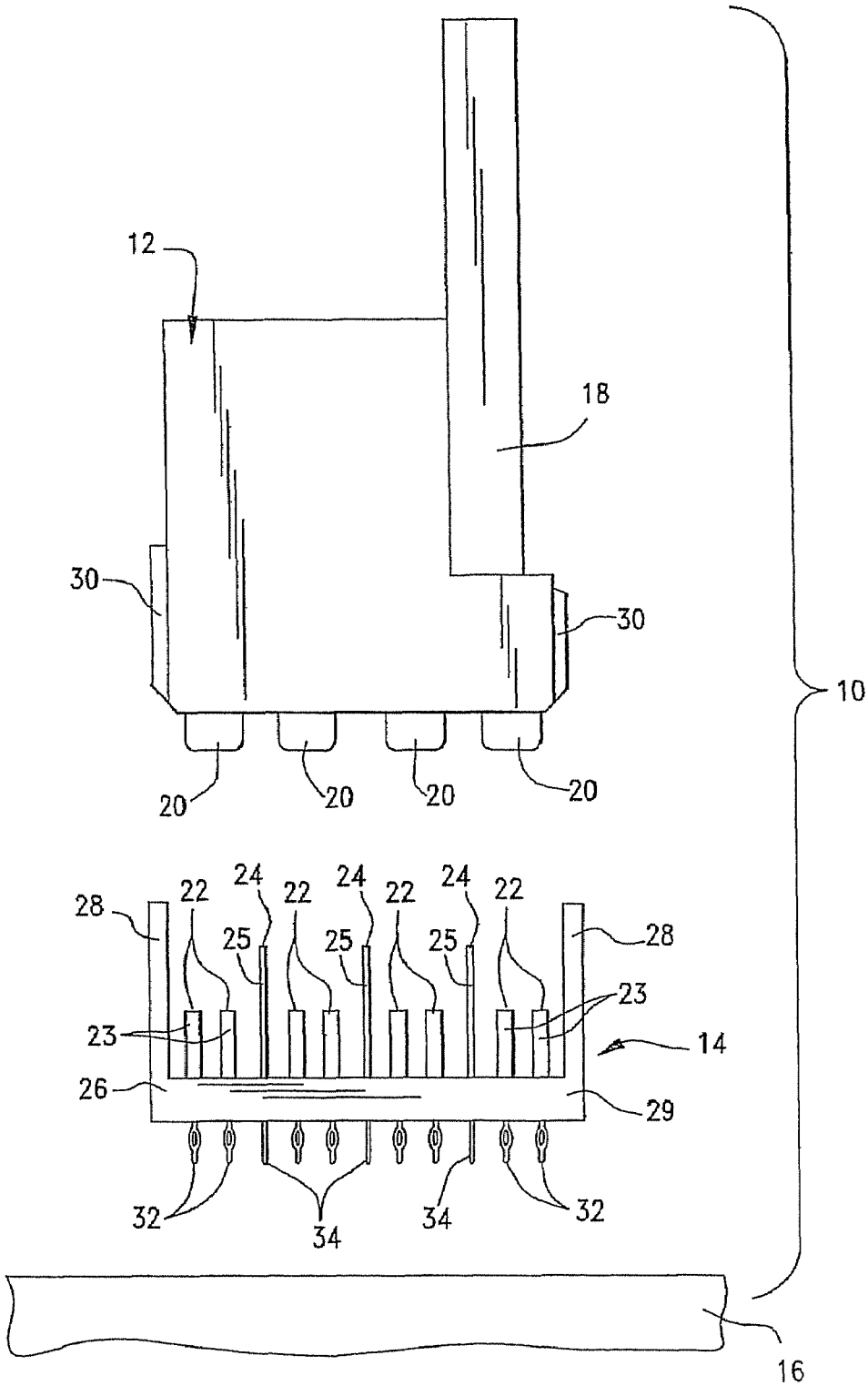
FIG. 1 is a simplified side view of a daughter card connector and associated backplane connector in accordance with an exemplary embodiment of the present invention.

FIG. 1 is a simplified side view of a high-density serial connector 10 comprising daughter card connector 12 and associated backplane connector 14 in accordance with an exemplary embodiment of the present invention. The exemplary serial connector 10 is illustrated as a GbX®-style 4-pair signal module having an 8×10 array of differential pins 22. The connector 10 can have the same size, mating characteristics and pin configuration as a conventional GbX® 4-pair connector. One example GbX® 4-pair daughter card connector is Molex part number 75220. Molex part number 75235-0X0X is the corresponding backplane connector.

The backplane connector 14 includes an array of differential pins 32 and ground plane shields 24. The backplane connector 14 is affixed to a backplane printed circuit board (PCB) 16 using a conventional technique such as soldering. The backplane PCB 16 can be a conventional PCB that typically includes one or more layers of conductive tracks for carrying signals provided by the differential-pair pins 22 and one or more ground signal tracks and/or planes connected to the ground shields 24.

A daughter card PCB 18 is affixed to daughter card connector 12. The daughter card connector 12 is designed to plug into or mate with backplane connector 14. The daughter card connector 12 includes internal conductors (not shown) for carrying signals from the differential pin pairs 22 to corresponding signal tracks formed in the daughter card PCB 18. The daughter card can be a conventional PCB having electrical components mounted thereon.

FIG. 1 shows eight differential pins 22, which is a subset of all of the differential pins in the backplane connector 14, and three ground shields 24 interposed between each pair of the pins. Each of the pin pairs is configured to either receive or transmit differential signals. Differential signaling uses two complementary signals sent on a pair of matched conductors. Differential signals are more resistant to noise than single ended signals. Noise introduced to a differential signal typically affects both of the complementary signals in the same way. Because of the differential nature of the signals on a pin pair 22, however, the noise tends to be cancelled. However, at high data rates, the differential signaling configuration because increasing less effective to reduce noise, which includes crosstalk interference from other nearby differential signals.

For purposes of terminology convention, the metal pins 22 are part of a "column" in a two-dimensional differential-pair pin array. "Columns" extend across the illustration. Each ground shield 24 illustrated in FIG. 1 is made up of a metal plate and is connected to ground to provide shielding between "rows" of the pin pairs. "Rows" extend in and out of the illustration in FIG. 1. Electromagnetic shielding such as the ground shield 24 limits the flow of electromagnetic fields. Although numerous techniques can be used to shield conductors in close proximity to one another, in this embodiment, a conductive ground shield 24 is placed between pin pairs. Although the example connector 10 shows only four pin pairs in a column, any suitable number of differential pairs may be used and arranged in any suitable two-dimensional array.

In accordance with an advantageous aspect of the invention, the daughter card connector 12 includes a plurality of electrically conductive shield tabs 20 extending downwardly between adjacent columns of differential pins 22 for reducing crosstalk among adjacent pairs of pins in a row. These shield tabs 20 are preferably grounded. When the daughter card connector 12 is plugged into the backplane connector 14, the crosstalk shield tabs 20 insert into the backplane housing floor 26 between columns of differential pins 22. This provides additional ground plane shielding around each differential pair, and when combined with the existing ground shields 24, the shielding extends in both the column and row directions of the differential pin array within the backplane housing floor 26. This additional shielding significantly reduces crosstalk between differential pairs. The backplane connector 14 includes female receptacle structures formed between adjacent differential pin columns for receiving the shield tabs 20 when the daughter card connector 12 and backplane connector 14 are attached together.

The backplane connector 14 also includes a non-conductive housing 29 having header sidewalls 28 extending from the housing floor 26 substantially parallel to each other. The differential-pair pins 22 and ground shields 24 are press-fitted into the floor 26 so as to pass through the floor 26. Each of the differential pins 22 has a generally flat upper portion 23 and an eye-of-the-needle pin 32 as a lower portion. Eye-of-the-needle pins are a type of compliant pin, which are typically used in high-speed applications. However, solder pins can also be used. Compliant pins mechanically attach the connector while providing an electrical interface. Each of the ground shields 24 has a generally flat upper blade 25 and one or more lower eye-of-the-needle pins 34.

The daughter card connector 12 has corresponding female structures for receiving the upper portion 23 of the pins 22, and the upper portion 25 of the shields 24. The housing sidewalls 28 have guide slots formed on their inside faces for receiving daughter card connector guides 30 when the daughter card connector 12 and the backplane connector 14 are plugged together. The guide slots and guides 30 help align the mating pairs of pins 22 with their corresponding female portions in the daughter card connector 12.

The backplane housing 29 can be made of any suitable electrically non-conductive material such as liquid crystal polymer (LCP), and is preferably created using a thermoplastic mold (e.g., conventional molding press) using conventional injection molding techniques.

Figure 2:
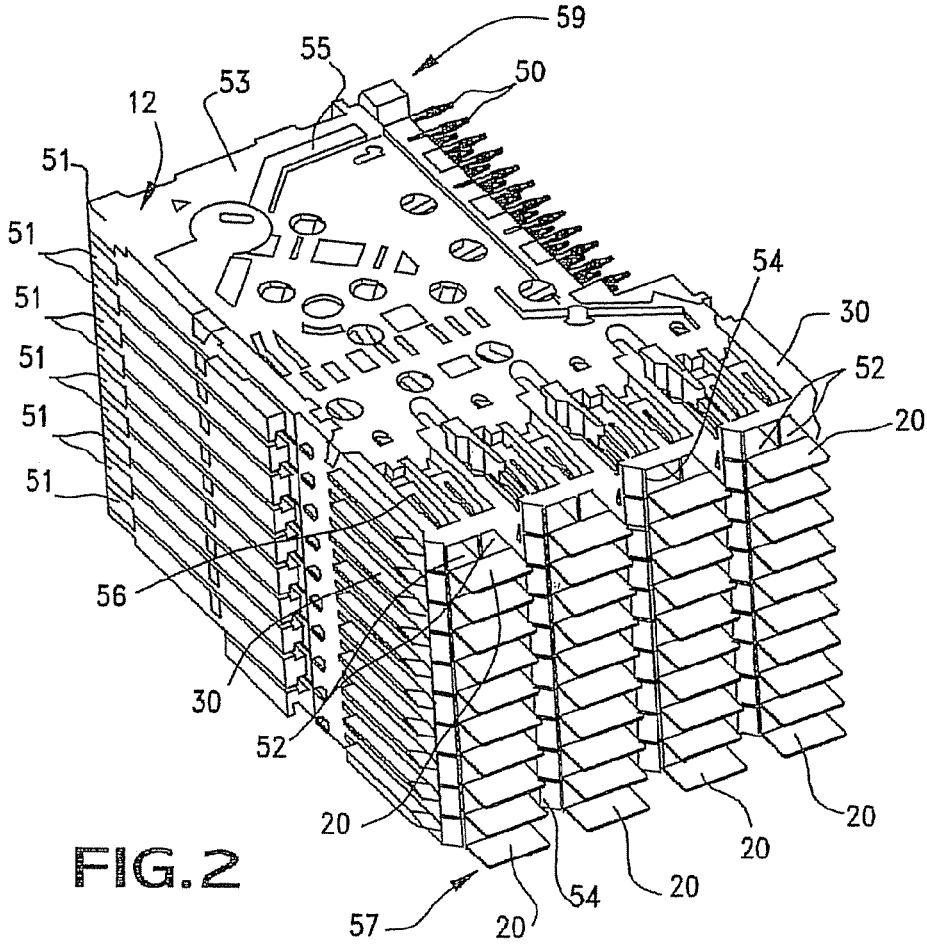
FIG. 2 is a perspective view of the daughter card connector shown in FIG. 1.

FIG. 2 is a perspective view of the daughter card connector 12 shown in FIG. 1. The daughter card connector 12 includes a backplane connector interface 57 comprising plural differential pair receptacles 52, ground blade slots 54 and crosstalk tabs 20 for connecting to the backplane connector 14. The daughter card connector 12 also includes a daughter card interface 59 comprising plural pins 50 for connecting to the daughter card 18 (FIG. 1).

The exemplary daughter card connector 12 illustrated in FIG. 2 is composed of ten identical "wafers" 51 stacked together. Each wafer 51 comprises a column of differential pin receptacles 52 and three ground blade slots 54 interposed between the differential pair receptacles 52. The ground blade slots 54 receive the ground shield 24 (FIG. 1) of the connector 14 (FIG. 1). Within each differential pin receptacle 52 is mounted a resilient differential conductor 56 for making electrical contact with a corresponding differential pin blade 24 when the daughter card connector 12 is plugged into the backplane connector 14. The differential conductors 56 pass through the wafer 51, electrically isolated from one another, and terminate with a corresponding eye-of-the-needle daughter card pin 50.

Figure 4:
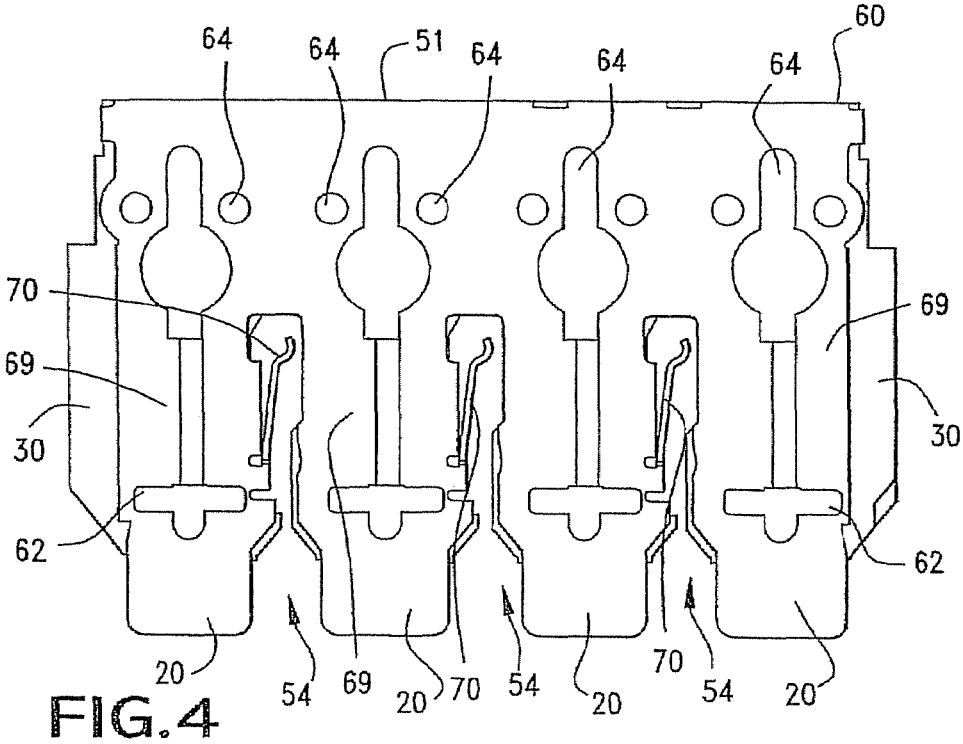
FIG. 4 is a back view of the wafer shown in FIG. 3.

Within each ground blade slot 54 are resilient conductor tangs 70, as best seen in FIG. 4, for making electrical contact with ground blades 25 (FIG. 1) when the daughter card connector 12 is plugged into the backplane connector 14.

Each wafer 51 also includes four crosstalk shielding tabs 20 extending along corresponding differential pair receptacles 52. The crosstalk shielding tabs 20 are part of a ground plane shield 60 (see FIG. 3) included in each wafer 51. Each wafer 51 also includes insertion guides 30 mated to corresponding guide slots formed in the backplane header 28.

Each wafer 51 includes a non-conductive body 53 and spacing rib 55, each made of injection molded plastic. The electrically conductive components are assembled into the body 53.

Figure 3:
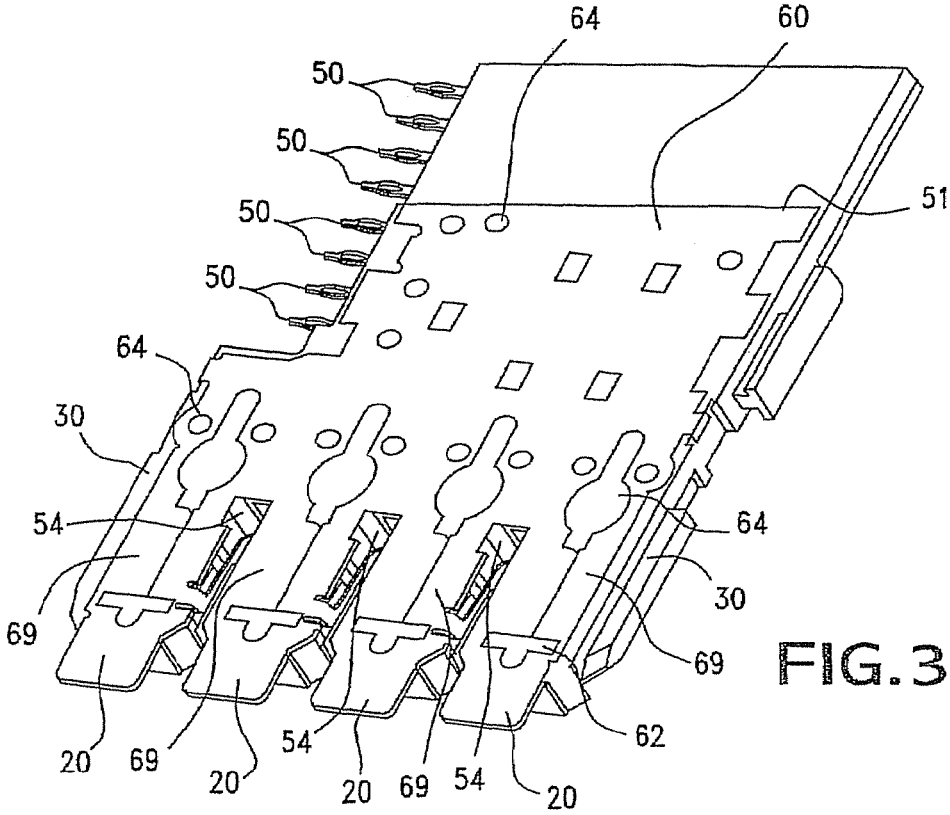
FIG. 3 is a perspective view of a single wafer of the daughter card connector shown in FIG. 2.

FIG. 3 is a perspective view of a single wafer 51 of the daughter card connector 12 shown in FIG. 2. This view of the wafer 51 shows the ground plane shield 60, which is mounted to the wafer body 53 using alignment lugs 62 of the body and lugs 64 (FIG. 3). The ground plane shield 60 is made of stamped metal and generally covers one side of the wafer 51 to provide electrical shielding between columns of differential pairs. The bottom portion of the ground plane shield 60 includes fingers 69 that terminate with the crosstalk tabs 20. The fingers 69 have spaces there between defining slots 54 for receiving the ground blades 25 (FIG. 1) of the backplane connector 14. The wafer 51 includes pins 50 for connecting to the daughter card PCB 18.

FIG. 4 is a detailed back view of the ground plane 60 side of the wafer 51 shown in FIG. 3. This view shows the resilient tangs 70 formed on each finger 69 of the ground plane shield 60. The tangs 70 contact the ground shield planes 25 (FIG. 1) when the ground shield planes are inserted into slots 54 of the wafer 51. Therefore, the ground shields 24 are in electrical contact with the ground plane 60 through the tangs 70. Additionally, shielding tabs 20 extend from the ground shield 60 and are therefore grounded at the same potential as the ground plane 60 and ground shields 24. The daughter card connector 12 and backplane connector 14 are grounded at the same potential through the shield plates 25 contacting the tangs 70. This grounding scheme significantly reduces differential pair crosstalk in the serial connector 10.

The ground plane 60 in FIGS. 3 and 4 includes lugs 64 and alignment lugs 62 for mounting to the wafer 51. Connector guides 30 allow the wafer 51 to mate with a corresponding backplane connector 14 (FIG. 1). The wafer 51 of FIGS. 3 and 4 is a one-piece assembly formed by a two shot molding process. The lugs 62 and 64 assist in aligning and retaining the ground plane 60 to the body of the wafer 51 during the molding process so the ground plane and wafer body are integral.

Figure 5:
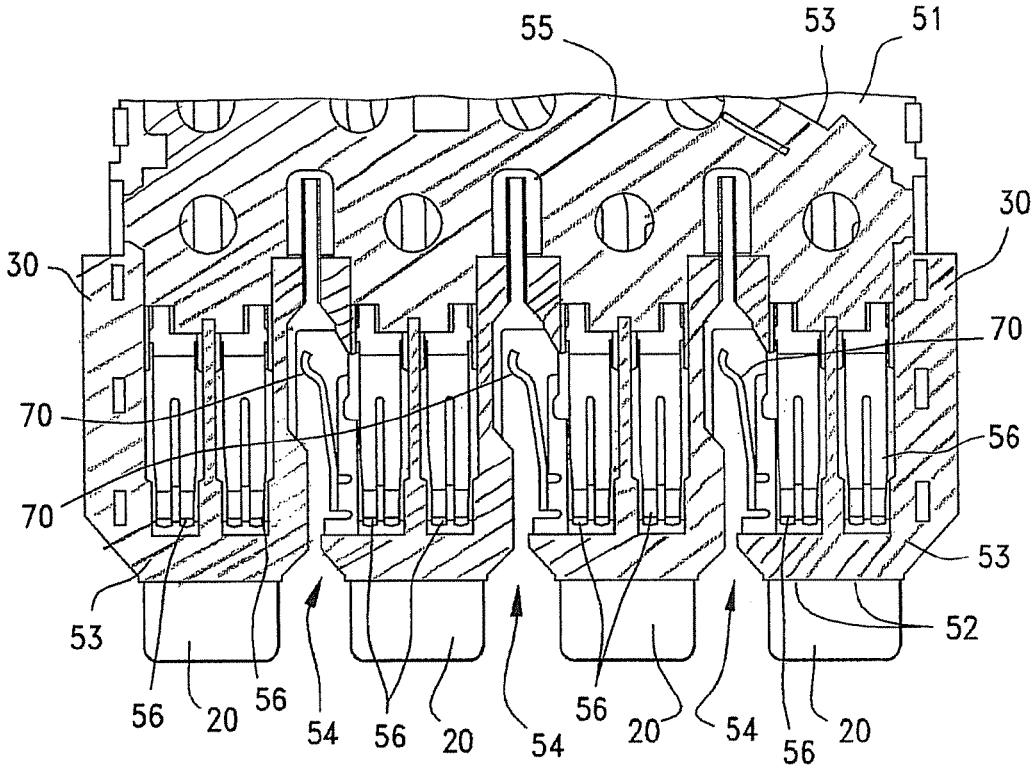
FIG. 5 is a front view of the wafer shown in FIG. 3.

FIG. 5 is a detailed front view of the other side of the wafer 51 shown in FIG. 3. This view shows the plastic body 53 of the wafer isolating each finger 69 (FIG. 4) of the ground plane 60 (FIG. 4) from the resilient differential conductors 56. For clarity, the non-conductive portions of the wafer are shaded. The fingers 69 provide shielding for the differential conductors 56, but must be electrically isolated from the connectors to prevent the connectors from shorting to ground. Tangs 70 protrude into slots 54 from the ground shield 60 (FIG. 4). The backside of crosstalk tabs 20 are visible extending below wafer 51.

Figure 6:
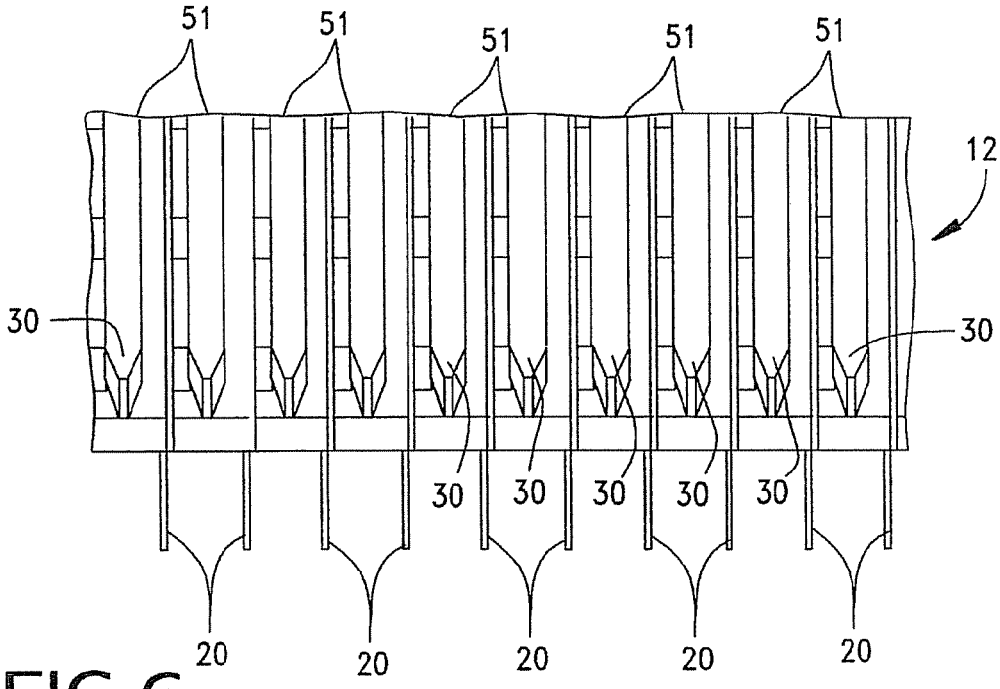
FIG. 6 is a partial side view of the daughter card shown in FIG. 2.

FIG. 6 is a partial side view of the daughter card connector 12 shown in FIG. 2. The wafers 51 are fastened together using any suitable conventional technique, such as ultrasonic welding, adhesives, integral press-fitting lugs or the like. Connector guides 30 on each of the wafers 51 allow the daughter card to mate with a corresponding backplane connector 14 (FIG. 1). Crosstalk tabs 20 extend from the daughter card connector 12.

Figure 7:
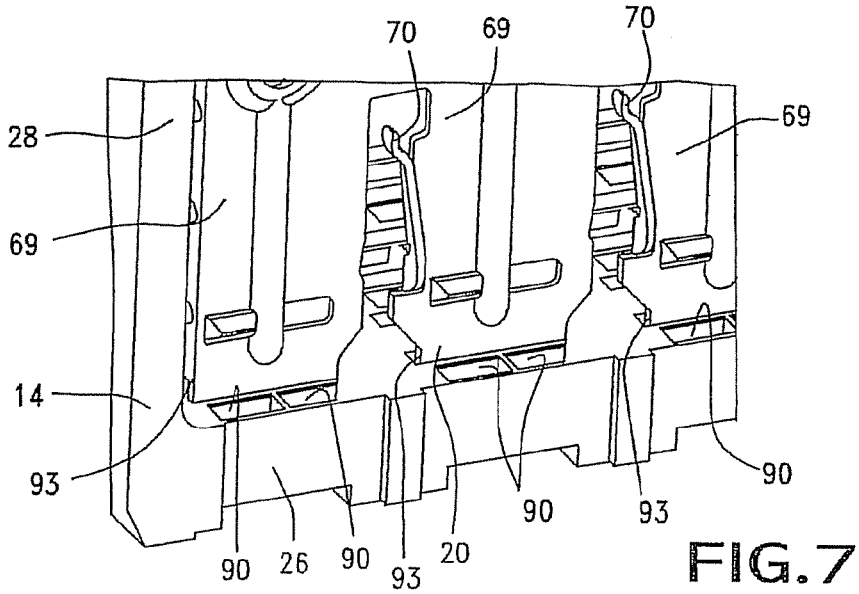
FIG. 7 is a partial top perspective view showing the daughter card connector ground plane inserted into the backplane connector.

FIG. 7 is a partial top perspective view of the daughter card connector 12 showing the ground plane 60 (FIG. 3) of the daughter card connector (FIG. 1) inserted into the backplane connector 14 (FIG. 1). The differential pins 22, ground blades 24, wafer body 53, and daughter card differential conductors 56 are omitted from this figure for clarity purposes. The crosstalk shield tabs 20 are inserted into corresponding tab receptacles 93 formed in the backplane connector floor 26. The length of the tabs 20 is selected so that the tabs 20 extend completely though the thickness of the floor 26. Other lengths can be used where suitable. For example, it is frequently necessary to have various circuits engage electrically before other circuits. Therefore, in some instances taller pins are used to engage some circuitry early then others as the connectors are joined. In some embodiments the length of the tab varies with the length of the corresponding pins. However, preferably, the tab shields extend substantially through the backplane housing (e.g. 95% through the housing) when the daughter card connector and backplane connector are mated. The housing floor 26 also has differential pin receptacles 90 formed therein. The differential pins 22 are press-fitted into these receptacles 90. Fingers 69 of ground plane 60 connect with tangs 70 in order to provide a ground connection to ground blades 24 (FIG. 1). Sidewall 28 provides mechanical stability for the backplane connector 14 and the daughter card connector 12.

Figure 8:
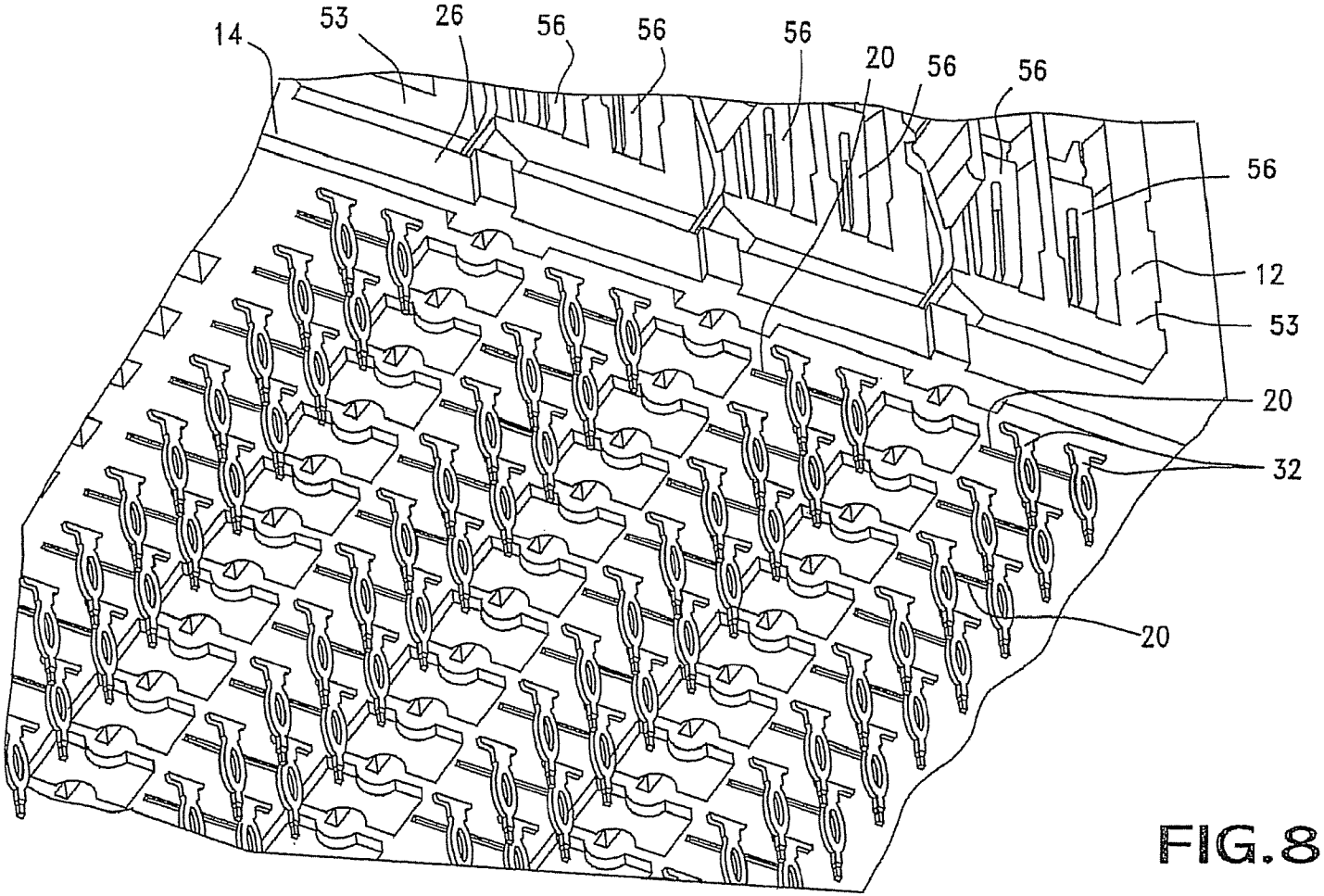
FIG. 8 is a partial bottom perspective view showing the daughter card connector inserted into the backplane connector.

FIG. 8 is a partial bottom perspective view showing the daughter card connector 12 (FIG. 1) inserted into the backplane connector 14 including the non-conductive housing 53. The ground plane blades 24 are omitted from this figure for clarity purposes. The bottom edge of tabs 20 are visible between the differential pair pins 32. The eye-of-the-needle ends of the differential pair pins 32 connect to the differential conductors 56.

Figure 9:
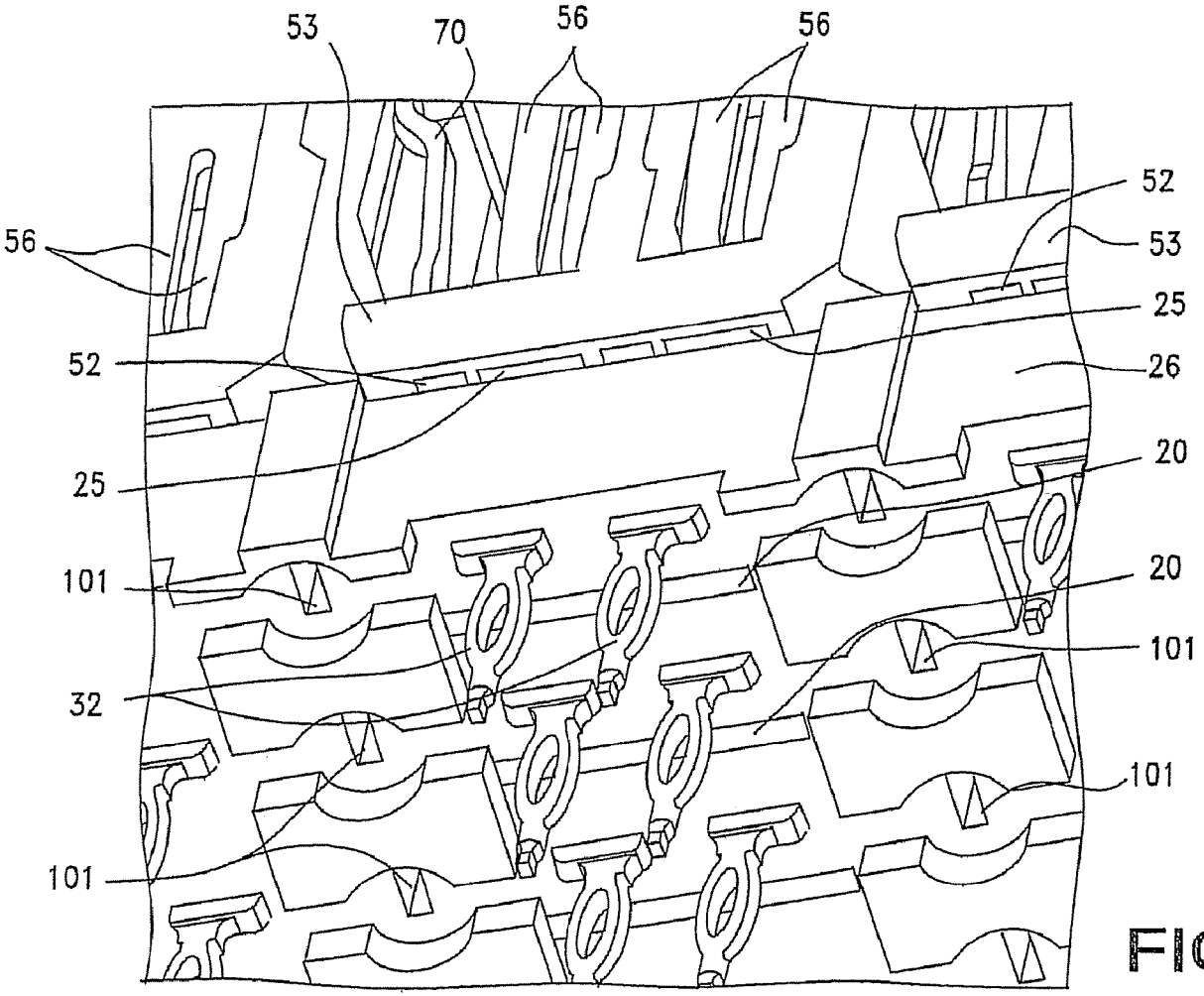
FIG. 9 is a detailed bottom perspective view showing the daughter card connector inserted into the backplane connector.

FIG. 9 is a detailed bottom perspective view showing the daughter card connector 12 (FIG. 1) inserted into the backplane connector 14 (FIG. 1). The ground plane blades 24 of the backplane connector 14 are omitted from this figure for clarity purposes. However, this view shows through-hole receptacles 101 formed in the backplane housing floor 26 for receiving the ground blade pins 34 of the ground shields 25, which are press-fitted into the through-holes. The bottom edges of tabs 20 are visible between the differential pair pins 32. The eye-of-the-needle ends of differential pair pins 32 connect to the differential conductors 56 as shown in FIG. 8. The ground blades 25 are visible above the backplane conductor. The non-conductive housing 53 and differential pair receptacles 52 are also visible between the daughter card connector 12 and the backplane connector 14.

In keeping with the invention, the backplane conductor 14 receives both daughter card connectors with and without the shield tabs 20. In this regard, some applications of the connector may not require supporting high speed, broad bandwidth connections. The backplane connector still contains tab receptacles 93. In this way, daughter boards 12 requiring high performance connectors can be mounted with daughter card connectors having shield tabs 20, while daughter boards having lower performance requirements can be mounted with daughter card connectors without the shield tabs. Both types of daughter card connectors can be mated with the same backplane connectors. The tab receptacle is not occupied when the backplane connector is mated with a daughter card connector that does not have shield tabs 20.

In some embodiments of the invention, the shield tabs 20 are located on the backplane connector. The daughter card connector has corresponding tab receptacles 93. In these embodiments the shield tabs 20 extend upwards from the backplane connector and engage the daughter connector when the two connectors mate.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An electrical connector for a plurality of differential pairs, comprising:

a first housing supporting a first array of differential pair conductors and a plurality of shield tab receptacles formed in the housing between adjacent columns of the differential pairs;

a second housing for mating with the first housing and supporting a second array of differential pair conductors and a plurality of electrically conductive shield tabs extending from the second housing between adjacent columns of the differential pairs for insertion into the shield tab receptacles of the first housing so as to provide an electromagnetic shield between adjacent columns of the first and second arrays of the differential pairs when the first and second housings are mated; and a plurality of conductive ground blades extending from the first housing and between adjacent rows of the first array of differential pairs, the ground blades configured to be inserted into the second housing when the housings are mated.

2. The electrical connector of claim 1 wherein the first housing is mounted to a backplane printed circuit board and the second housing is a mounted to a daughter printed circuit board.

3. The electrical connector of claim 1 wherein the second housing comprises a plurality of stacked wafers, each wafer having a ground shield extending beyond the wafer to form the conductive shield tabs.

4. The electrical connector of claim 1 further comprising contacts for electrically connecting the shield tabs to the ground blades.

5. The electrical connector of claim 4 wherein the contacts include a plurality of resilient and conductive tangs electrically coupled to the tabs for making physical contact with the ground blades.

6. A first connector secured to a first printed circuit board for mating to a second connector secured to a second printed circuit board in order to communicate signals between the first and second printed circuit boards via a plurality of differential pairs, the first connector comprising:

a housing having a plurality of differential pair conductors for mating with a complementary plurality of differential pair conductors of the second connector;

a plurality of grounded tabs extending downwardly from a surface of the housing for mating with a complementary surface of the second connector; and contacts for electrically connecting the grounded tabs to a plurality of ground blades extending from the second connector, wherein the contacts includes a plurality of resilient conductive tangs operatively coupled to the tabs for making electrical contact with the ground blades.

7. The first connector of claim 6 wherein the housing comprises a plurality of wafers, each wafer including (1) a non-conductive body, (2) a row of the differential pair conductors providing electrical paths for the signals through the non-conductive housing, and (3) electrically conductive shielding integrated with the non-conductive body and having the tabs extending therefrom.

8. The first connector of claim 7 wherein the conductive shielding is grounded and substantially planar.

9. An electrical connector for a plurality of differential pairs, comprising:

a female portion including a first plurality of differential pair conductors and a receptacle formed in the female portion between each adjacent pair of the differential pair conductors; and a male portion for mating to the female portion and including a second plurality of differential pair conductors formed in the male portion for mating to the first plurality of differential pair conductors and a plurality of electrically conductive and grounded shield tabs extending from a surface of the male portion between adjacent ones of the second plurality of differential pair conductors for insertion into the receptacles when the male and female portions are mated together so as to reduce crosstalk between the adjacent ones of the differential pairs.

10. The electrical connector of claim 9 wherein one of the male and female portions is mounted to a backplane printed circuit board and the other portion is mounted to a daughter printed circuit board.

11. The electrical connector of claim 9 further comprising a plurality of conductive ground blades extending from one of the male and female portions, the ground blades being in contact with the shield tabs when the male and female portions are mated.

12. The electrical connector of claim 11 further comprising conductive receptacles for receiving the ground blades when the male and female portions are mated so as to electrically connect the shield tabs to the ground blades.

13. The electrical connector of claim 12 wherein each of the conductive receptacles includes a resilient conductive tang operatively coupled to one of the tabs for making electrical contact with one of the ground blades.

14. The electrical connector of claim 9 wherein one or both of the male and female portions includes a plurality of stacked wafers, each wafer including a non-conductive body having (1) a row of the differential pair conductors, (2) a plurality of electrical paths from the row of differential pair conductors through the non-conductive body, and (3) electrically conductive shielding integrated with the non-conductive body and extending from the wafer to form the tabs.

15. The electrical connector of claim 14 wherein the conductive shielding is grounded and substantially planar.

16. An electrical connector comprising a housing supporting (1) a first array of conductive pairs forming columns and rows and (2) a surface with an array of receptacles in the housing interlaced among the array of the conductive pairs such that the receptacles are between columns of the conductive pairs such that the receptacles receive a plurality of electrically conductive tabs extending from a mating electrical connector in order to form a ground plane extending into an interior region of the housing that electrically isolates the columns of the conductive pairs.

17. The electrical connector of claim 16 wherein the housing is mounted to a first printed circuit board and the mating electrical connector is mounted to a second printed circuit board.

18. The electrical connector of claim 16 wherein the tabs are grounded by ground shields extending between rows of the conductive pairs when the housing is joined to the mating electrical connector.

* * * * *